US009777930B2

(12) United States Patent
Langenbach et al.

(10) Patent No.: US 9,777,930 B2
(45) Date of Patent: Oct. 3, 2017

(54) DOWNDRAFT THAT IS TELESCOPING

(75) Inventors: Gerhart S. Langenbach, Oconomowoc, WI (US); John J. Huber, Delafield, WI (US); William Punzel, Edgerton, WI (US); Conrad G. Bohlman, Watertown, WI (US)

(73) Assignee: Western Industries, Inc., Watertown, WI (US)

( * ) Notice: Subject to any disclaimer, the term of this patent is extended or adjusted under 35 U.S.C. 154(b) by 1410 days.

(21) Appl. No.: 13/489,071

(22) Filed: Jun. 5, 2012

(65) Prior Publication Data

US 2013/0319400 A1 Dec. 5, 2013

(51) Int. Cl.
*F24C 15/20* (2006.01)

(52) U.S. Cl.
CPC ..... *F24C 15/2042* (2013.01); *F24C 15/2092* (2013.01)

(58) Field of Classification Search
CPC ..... F24C 15/2042; F24C 15/2085
USPC ..... 126/299 R, 299 D
See application file for complete search history.

(56) References Cited

U.S. PATENT DOCUMENTS 2,620,127 A * 12/1952 Radcliffe ..... F04D 29/646 126/299 R
3,381,927 A 5/1968 Stamates
3,786,219 A 1/1974 Kornrumpf et al.
3,797,375 A 3/1974 Cerola
3,905,760 A 9/1975 Johansson
4,013,859 A 3/1977 Peters, Jr.
4,100,964 A 7/1978 Gorechev et al.
4,114,009 A 9/1978 Kiuchi et al.
4,149,217 A 4/1979 Tucker
4,169,222 A 9/1979 Tucker
4,191,875 A 3/1980 Cunningham
4,200,280 A 4/1980 Goodwin
4,206,336 A 6/1980 Cunningham
4,308,443 A 12/1981 Tucker et al.
4,371,780 A 2/1983 Gossler
4,396,818 A 8/1983 Kominami et al.
4,415,788 A 11/1983 Field
(Continued)

FOREIGN PATENT DOCUMENTS

CA 2229268 2/1998
CA 2348680 5/2001
(Continued)

OTHER PUBLICATIONS

DefineXL2011, Sep. 5, 2011, Fractal Design, https://web.archive.org/web/20111005003718/http://www.fractal-design.com/?view=product&category=2&prod=68.*
(Continued)

*Primary Examiner* — Avinash Savani
*Assistant Examiner* — Aaron Heyamoto
(74) *Attorney, Agent, or Firm* — Boyle Fredrickson, S.C.

(57) ABSTRACT

A telescoping downdraft ventilator with a movable fan and efficient way of removing gases and fumes is disclosed. The telescoping downdraft ventilator has the ability to fit behind a cook top unit beneath a countertop when the cook top unit is located against a wall. The telescoping downdraft ventilator has a fan that may be attached in front of the unit or behind the unit. The ventilator collects and draws in exhaust fumes and smoke, filters it, and re-circulates or expels it through a movable exhaust duct.

18 Claims, 12 Drawing Sheets

(56) References Cited

U.S. PATENT DOCUMENTS 4,431,892 A 2/1984 White
4,446,350 A 5/1984 Mizukawa et al.
4,446,849 A 5/1984 McFarland
4,447,691 A 5/1984 Mizukawa et al.
4,453,067 A 6/1984 Karklys et al.
4,453,068 A 6/1984 Tucker et al.
4,490,596 A 12/1984 Hirai et al.
4,501,260 A 2/1985 Grace
4,511,781 A 4/1985 Tucker et al.
4,549,052 A 10/1985 Simon
4,562,827 A 1/1986 Cerola
4,584,849 A * 4/1986 Cloudy ..... F25D 13/067 62/303
4,603,684 A 8/1986 Kazuo et al.
4,686,340 A 8/1987 Fukasawa
4,701,588 A 10/1987 Fukasawa
4,736,729 A 4/1988 Beach
4,750,470 A 6/1988 Beach et al.
4,757,177 A 7/1988 Suzuki et al.
4,766,880 A 8/1988 von Blanquet
4,784,114 A 11/1988 Muckler et al.
4,810,847 A 3/1989 Ito
4,833,288 A 5/1989 Poumey
4,846,146 A 7/1989 Tucker et al.
4,881,870 A 11/1989 Ritter et al.
4,886,046 A 12/1989 Welch
4,887,587 A 12/1989 Deutsch
4,899,028 A 2/1990 Arai et al.
4,908,489 A 3/1990 Panecki et al.
4,934,337 A * 6/1990 Falk ..... F24C 15/2078 126/299 R
4,945,891 A 8/1990 Cecil
4,951,646 A 8/1990 Diekmann et al.
5,000,160 A 3/1991 Dunlop et al.
5,001,970 A 3/1991 Graver
5,010,223 A 4/1991 Kim
5,062,410 A 11/1991 Sarnosky et al.
5,111,014 A 5/1992 Tanaka et al.
D327,538 S 6/1992 Falk et al.
5,119,802 A 6/1992 Cherry et al.
5,158,068 A 10/1992 Pickering
5,190,026 A 3/1993 Doty
5,208,217 A 5/1993 Katsoyannis
5,209,217 A 5/1993 Beach et al.
5,213,091 A 5/1993 Beach
5,231,972 A 8/1993 Galassi
5,279,279 A 1/1994 White
5,286,942 A 2/1994 McFadden et al.
5,287,799 A 2/1994 Pickering et al.
5,301,653 A 4/1994 Gerdes et al.
5,325,842 A 7/1994 Beach et al.
5,370,576 A 12/1994 Krofchalk
5,376,775 A 12/1994 Lee
5,428,207 A 6/1995 Essig et al.
5,430,273 A 7/1995 Bogdanski et al.
5,446,268 A 8/1995 Chen
5,549,098 A 8/1996 Bales
5,566,644 A 10/1996 Beery
5,572,205 A 11/1996 Caldwell et al.
5,577,490 A 11/1996 Overton, Jr.
5,619,982 A 4/1997 Kelly et al.
5,690,093 A 11/1997 Schrank et al.
5,884,619 A 3/1999 Terry
5,900,175 A 5/1999 Kicherer et al.
6,000,391 A 12/1999 Timmons
6,119,680 A 9/2000 Barritt
6,168,378 B1 1/2001 Craw et al.
6,190,498 B1 * 2/2001 Blagborne ..... B01D 1/16 159/16.1
6,198,080 B1 3/2001 Rice et al.
6,202,638 B1 3/2001 Didio-Sayer
6,236,024 B1 5/2001 Gotz et al.
6,276,358 B1 8/2001 Brin, Jr. et al.
6,293,276 B1 9/2001 Owens et al.
6,297,482 B1 10/2001 Becker
6,316,753 B2 11/2001 Clothier et al.
6,320,169 B1 11/2001 Clothier
6,444,958 B1 9/2002 Campbell
6,455,818 B1 9/2002 Arntz et al.
6,484,713 B1 11/2002 Schmitt
6,492,622 B2 12/2002 Melson
6,501,053 B2 12/2002 Becker et al.
6,528,770 B1 3/2003 Akel et al.
6,528,772 B1 3/2003 Graves et al.
6,548,894 B2 4/2003 Chu
6,555,794 B2 4/2003 Leutner et al.
6,575,157 B1 6/2003 Shaver
6,584,744 B1 7/2003 Schultheis
6,600,139 B2 7/2003 Perschl et al.
6,630,650 B2 10/2003 Bassill et al.
6,639,190 B2 10/2003 Lerner
6,647,978 B1 11/2003 Khosropour
6,660,980 B2 12/2003 Nagata et al.
6,660,981 B2 12/2003 Ogata et al.
6,737,617 B1 5/2004 Daum et al.
6,770,857 B2 8/2004 Hirota et al.
6,807,962 B2 10/2004 Taplan et al.
6,809,301 B1 10/2004 McIntyre et al.
6,821,318 B2 11/2004 Khosropour
6,821,628 B2 11/2004 Schultheis et al.
6,828,530 B2 12/2004 Boegel et al.
6,841,760 B2 1/2005 Whipple
6,864,472 B2 * 3/2005 Kang ..... H05B 6/6429 126/21 A
6,933,474 B2 8/2005 Shukla
6,956,188 B2 10/2005 De Rooig et al.
7,022,949 B2 4/2006 Shukla
7,038,176 B2 5/2006 Sterling
7,049,552 B2 5/2006 Arntz et al.
7,049,563 B2 5/2006 Keishima et al.
7,051,802 B2 5/2006 Baer
7,081,603 B2 7/2006 Hoh et al.
7,102,109 B2 9/2006 Niiyama et al.
7,135,661 B2 11/2006 Park
7,186,955 B2 3/2007 Fisher
7,263,989 B2 9/2007 Yamauchi
7,423,244 B2 9/2008 Baier et al.
7,687,748 B2 3/2010 Gagas
7,836,877 B2 11/2010 Gagas
D643,528 S 8/2011 Jonovic et al.
8,020,549 B2 9/2011 Huber
8,066,000 B2 * 11/2011 Tsakiris ..... F24C 15/2071 126/299 D
D655,805 S 3/2012 Jonovic
2002/0063327 A1 5/2002 Chu
2002/0189798 A1 12/2002 Jacobs
2003/0226560 A1 12/2003 Shekarri
2004/0000543 A1 1/2004 Dudek et al.
2004/0026946 A1 2/2004 Reed
2006/0176654 A1 8/2006 Kfoury
2008/0029081 A1 * 2/2008 Gagas ..... F24C 15/2035 126/299 D
2008/0185376 A1 8/2008 Gagas et al.
2009/0137201 A1 5/2009 Huber
2010/0163549 A1 7/2010 Gagas et al.
2012/0204855 A1 8/2012 Huber
2013/0167826 A1 * 7/2013 Feld ..... F04D 25/082 126/299 D

FOREIGN PATENT DOCUMENTS

CA 2388774 6/2002
CA 2391688 10/2003
CA 2447108 10/2003
CA 2466258 8/2005

OTHER PUBLICATIONS

Page from Sears website www.sears.com/download/misc/kMInduct.pdf entitled *Designed for the Everyday Chef*, USA, Jan. 12, 2006.

(56) References Cited

OTHER PUBLICATIONS

*Research on Required Exhaust Flow Rate in Commercial Kitchens in the Case of Gas-Fired and Induction-Heating Cooking Equipment*, OSAKAGAS Technical Sheet, website www.osakagas.co.jp/rd/sheet/061e.htm, Japan.
*Induction Cooktops*, Australian Consumers' Association website www.choice.com.au, Australia.
*The Induction Hob Class Induction Technical Training*, Brandt Customer Services Formation CU3-Induction-002UK-02/03, ElcoBrandt training manual, France.
*10-Bit Rotary Encoder IC Supplants Optical Encoder*, Electronic Products 29th Annual Product of the Year Awards, Jan. 2005, US.
Flexpoint Flexible Sensor Systems Inc., Multi-Purpose Bend Sensors® product specification, US.

* cited by examiner

DOWNDRAFT THAT IS TELESCOPING

BACKGROUND OF THE INVENTION

1. Field of the Invention

The present invention relates in general to the field of downdraft ventilators for use in conjunction with a cook top. More particularly, the present invention relates to a telescoping downdraft ventilator assembly having a movable fan allowing installation in limited space environments.

2. Discussion of the Related Art

Telescoping downdraft ventilators are well known to those skilled in the art. A conventional telescoping downdraft ventilator typically includes a housing, e.g., usually positioned behind a cook top, and a vent that is extendable above the housing to remove contaminated air from a cook top. A trim piece typically covers the hole cut out in the countertop surrounding the downdraft ventilator. When not in use, the telescoping portion of the vent is usually stored in a housing below the cook top. Further, the ventilator typically includes a fan for moving air through the system.

One problem with prior designs is that oftentimes the cook top is located against a wall or above a storage cabinet. Such a location minimizes the space which a downdraft may occupy for the housing, fan, motor, etc. Thus, it is common to install a cook top in a kitchen island, allowing more space for a downdraft ventilator installation.

What is therefore needed is a system for use in conjunction with a telescoping downdraft ventilator that allows the fan assembly to be movable, allowing the downdraft ventilator to be installed against a wall or another limited space environment.

SUMMARY AND OBJECTS OF THE INVENTION

By way of summary, one object of the present invention is to provide a way of allowing installation of a telescoping downdraft ventilator into a confined area by having a movable exhaust fan housing allowing the exhaust duct to be pointed in a number of directions.

Another object of the present invention is to allow the exhaust fan housing to be mounted on the front or rear of the ventilator allowing installation of the ventilator against a wall or along the edge of an island.

A further aspect of the present invention is achieved by having slots cut on the housing for attaching the fan housing. The fan housing may be positioned anywhere along the slots.

Yet another object of the present invention is to provide a trim panel that is constructed out of one piece surrounding the telescoping member, also referred to as an inner member. A cap is placed on the top side of the inner member that fits into the trim panel when the inner member is retracted into the housing. The cap is manufactured by forming a flange on the underside of the cap in order to increase the surface area on the underside. The enlarged surface area minimizes pressure applied to an object or a user's fingers in the event an object becomes pinched when the inner member is retracted. The one piece construction significantly lowers manufacturing costs while the design offers greater safety to the end user. Spacers may also be placed on the underside of the cap which minimizes the potential pinch points.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1A:
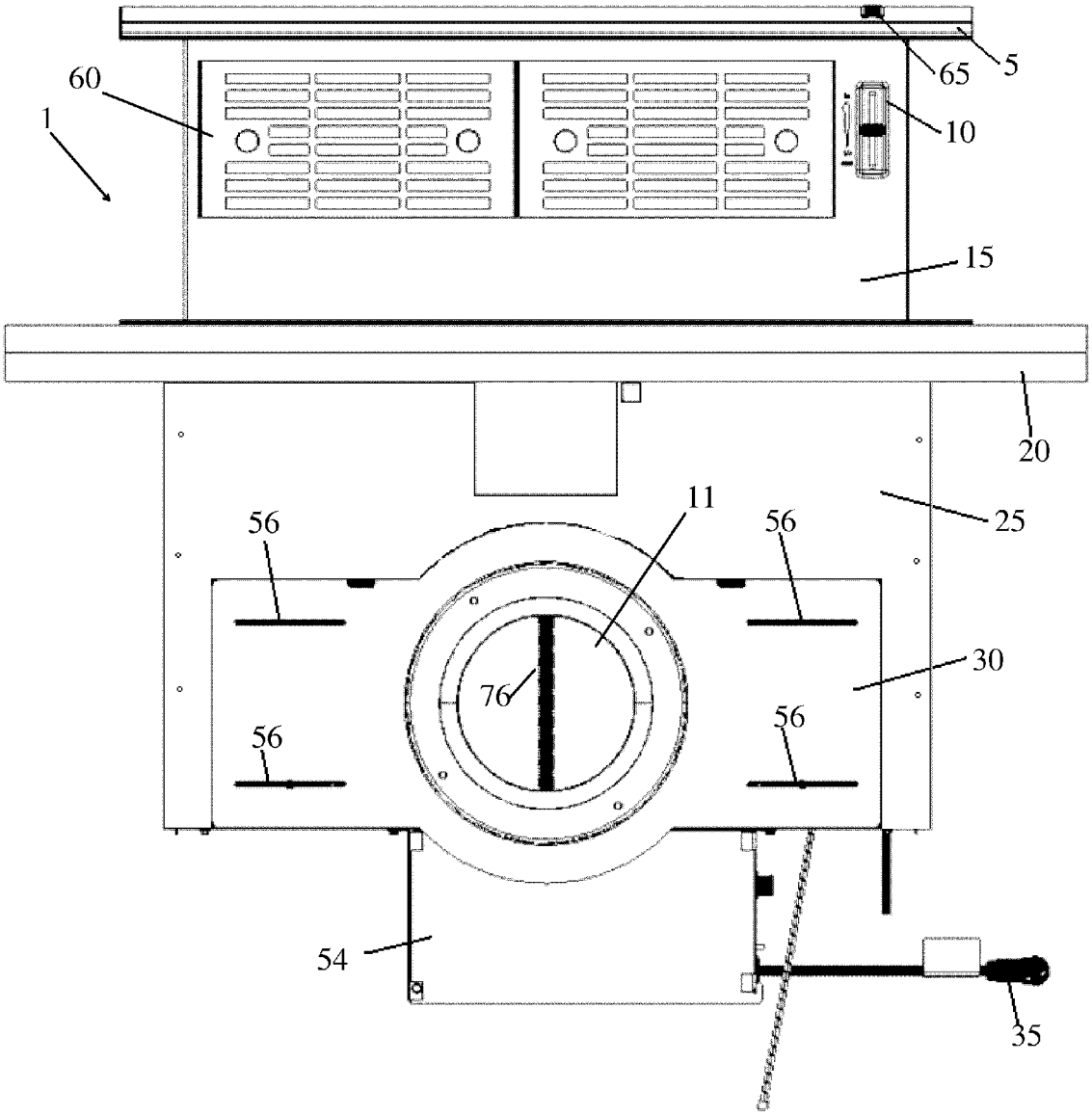
FIG. 1A illustrates a front view of the telescoping downdraft ventilator of the present invention without a blower.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The telescoping downdraft ventilator of the present invention generally includes a system with a fan housing to be relocatable to the front or rear of the ventilator, positionable along slots along the front and rear of the ventilator, includes a one piece construction trim, and a cap that minimizes pinch pressure on an operator's fingers. The telescoping downdraft ventilator may also include a fan housing that is also rotatable about its center axis. This is preferably accomplished by constructing the ventilator with a housing that is mounted below a countertop. The housing has front and rear panels with hole cut outs, allowing the fan housing to attach to the front or rear. Slots cut into the panels allow the fan housing to be positionable along the slots. The fan housing may also be rotated about its central axis when mounting to the panel of choice. These features allow the ventilator to be installed against a wall where traditional ventilators would not function as the fan housing would prevent the ventilator from being placed flush, against the wall. Since the fan housing has the ability to move, things such as drawers, shelves, plumbing, and electrical lines may be avoided by positioning the fan housing to an appropriate location. Since the exhaust duct attaches to the fan housing, installation of the exhaust duct plumbing is also simplified as the exhaust duct outlet may be pointed in an optimal direction. New construction techniques used also allow a trim panel mounted on the countertop, surrounding the telescoping portion, to be constructed out of a single piece. A cap secured to the top portion of an inner member minimizes pinch pressure by spreading the load on an operator's fingers over a larger surface area should the operator's fingers interfere with the telescoping function. Spacers may also be secured to the underside of the cap to reduce the pinch point area.

2. Detailed Description of Preferred Embodiments

Figure 1B:
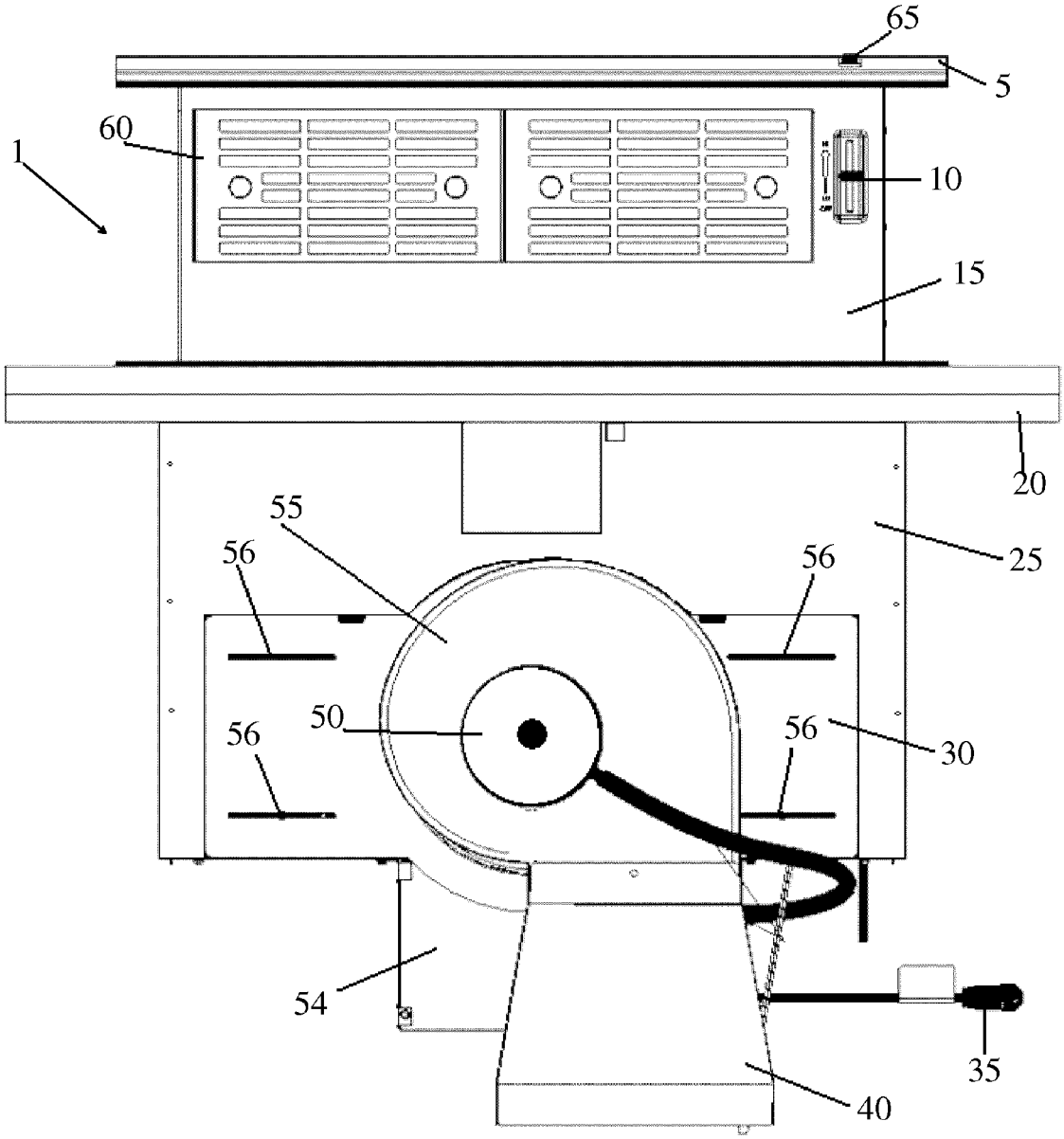
FIG. 1B illustrates a front view of the telescoping downdraft ventilator of the present invention with an external, rotational blower.
Figure 1C:
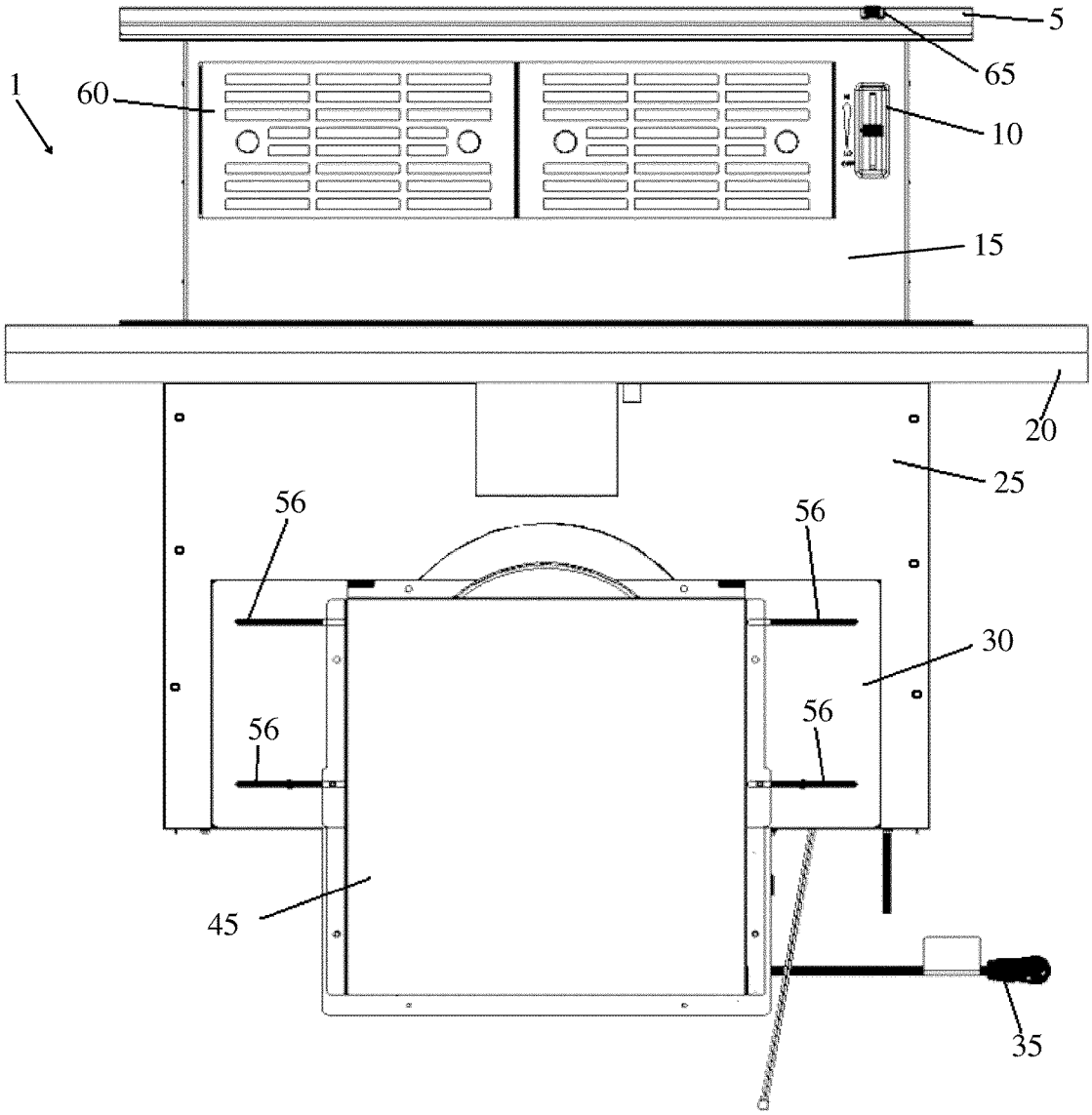
FIG. 1C illustrates a front view of the telescoping downdraft ventilator of the present invention with an internal blower.
Figure 8:
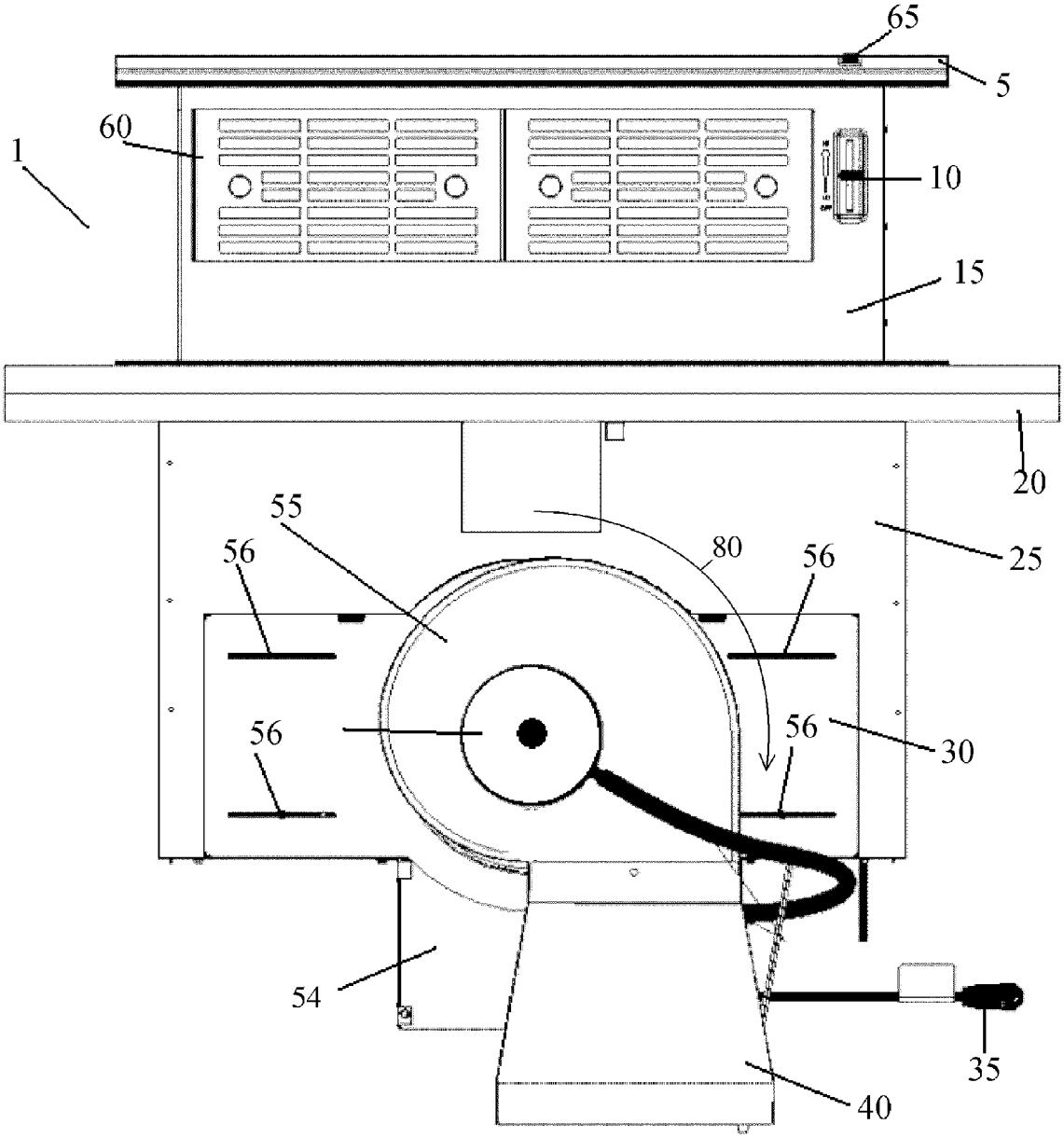
FIG. 8 illustrates a front view of the telescoping downdraft ventilator of an alternate embodiment indicating the rotation of the fan housing and exhaust duct.

Referring now to the drawings, FIG. 1A shows the telescoping downdraft ventilator 1 of the present invention without a fan housing. The downdraft ventilator 1 comprises a housing 25 with a cover plate 30 fastened to the front of the housing 25. A hole cutout 11 reveals the inside of housing 25 and a screw drive 76 for extending and retracting inner member 15. FIG. 1B shows a fan housing 55 that mounts over the hole cutout 11 onto the mounting panel 30 by attaching to the mounting panel 30 with fasteners. The fan housing 55 may rotate about its central axis as is shown in FIG. 8 with rotation arrow 80. A fan 57, shown in FIG. 8, is located inside the fan housing 55 and is powered by a motor 50. The fan 57 draws air from a cooking surface into the intake 60, through the internal member 15, down through the housing 25, through mounting panel 30, into fan housing 55 and blows the air out of exhaust duct 40. FIG. 1C shows a housing 45 that may be used for low profile applications. Housing 45 allows for a remote fan and fan motor to be installed, allowing the telescoping downdraft ventilator to be installed in a tight location that would not provide adequate room for a fan housing 55 and exhaust duct 40 as shown in FIG. 1B. Housing 45 may discharge exhaust air to the bottom of the housing 45.

The internal member 15 may be extended or retracted by pressing the on/off button 65. FIG. 1A discloses the internal member 15 in the fully extended position. A sliding button 10 may control the fan motor 50 as shown in FIG. 1B or the remote fan motor that would be used in FIG. 1C. In either application, the fan motor speed, which dictates the fan speed, is adjusting the sliding button 10. Sliding button 10 may be slid to select an infinite number of fan speeds between a maximum speed and a minimum speed.

A trim panel 20 rests above a countertop when the downdraft ventilator 1 is installed. The internal member 15 is retracted by an operator pressing the on/off button 65 which retracts the internal member 15 into the housing 25 to the fully retracted position, which places the lower portion of a cap 5 resting on the trim panel 20.

Figure 5:
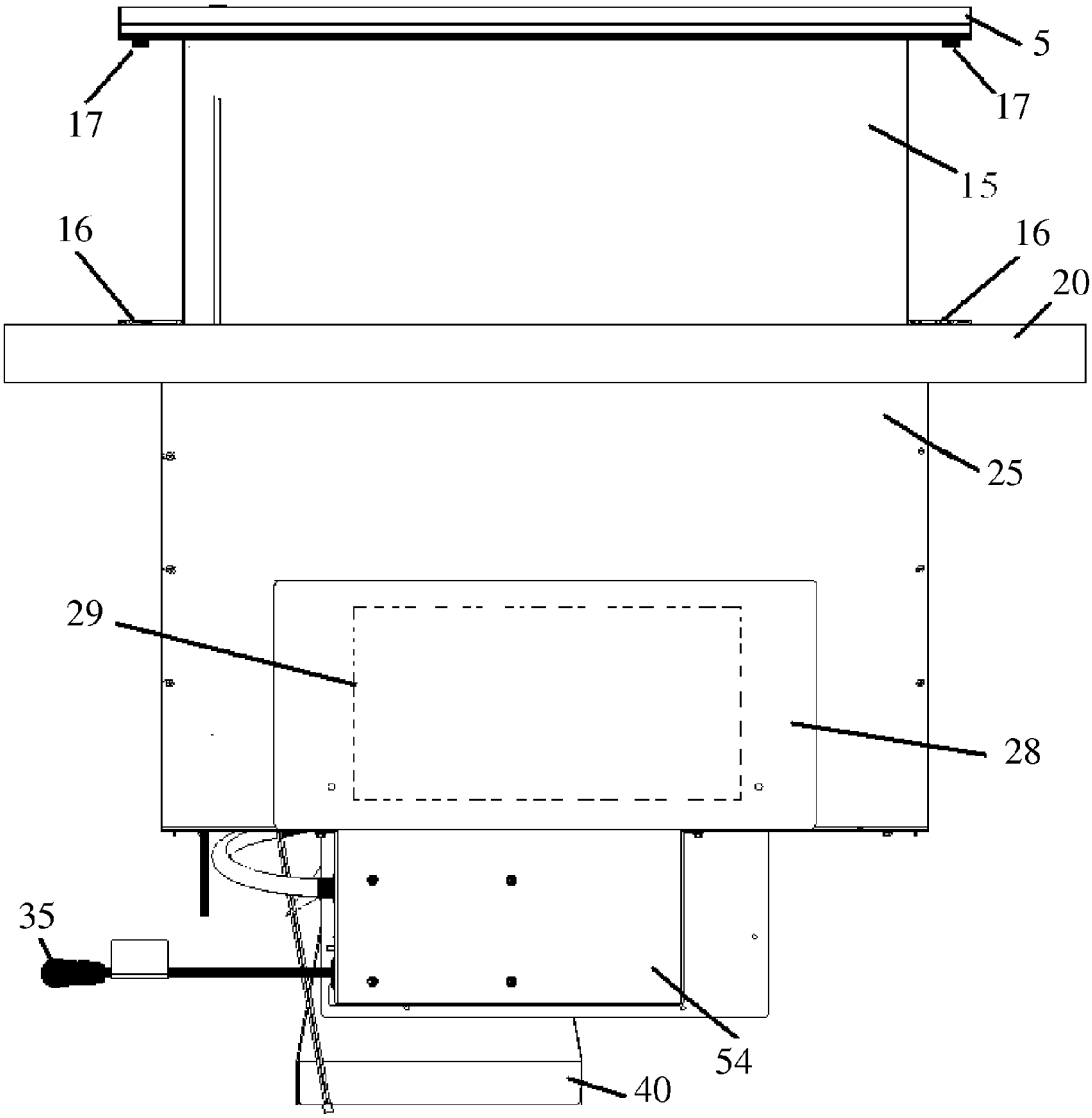
FIG. 5 illustrates a back view of the telescoping downdraft ventilator.
Figure 6:
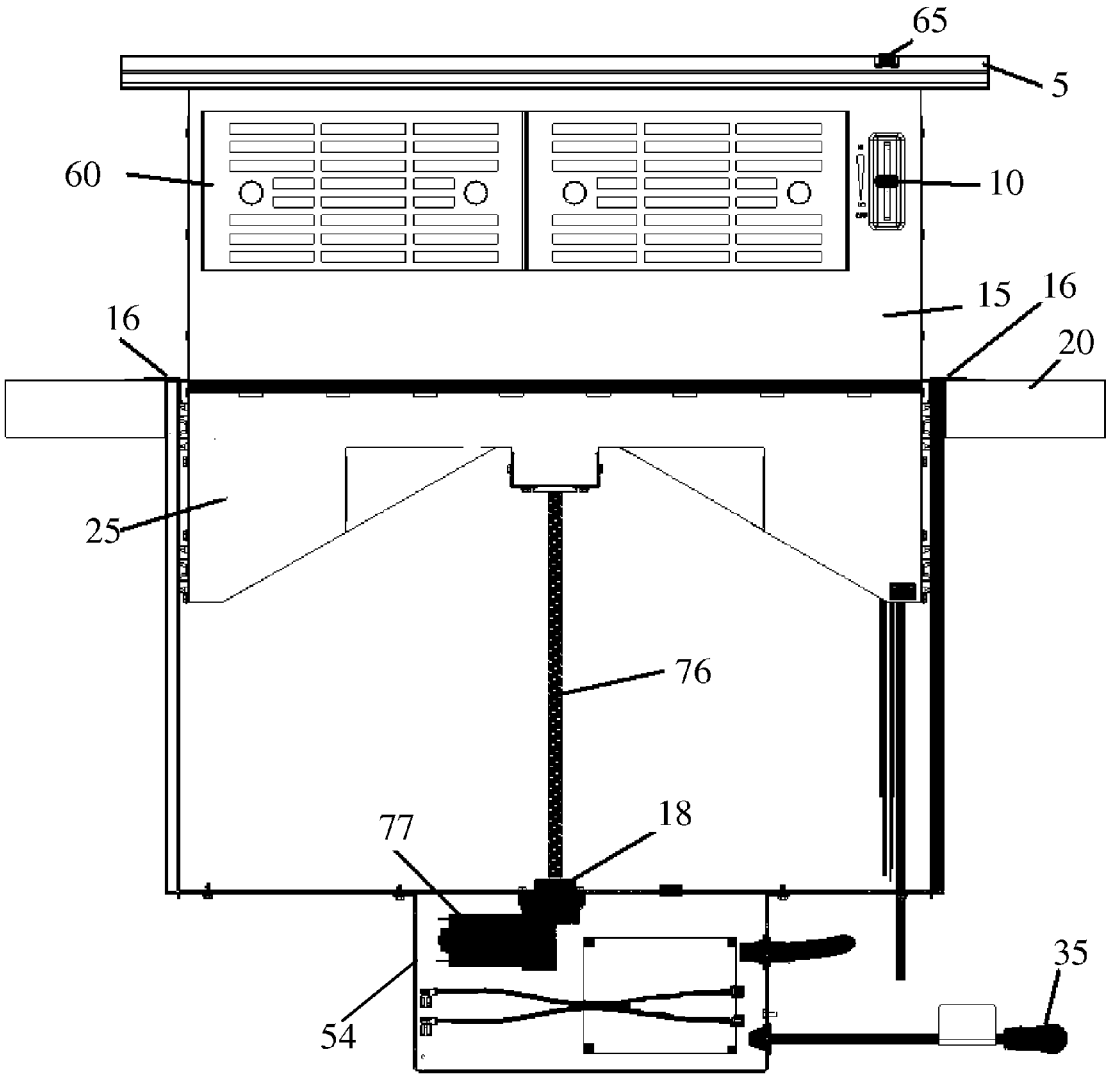
FIG. 6 illustrates a cross-sectional view of the downdraft ventilator of FIG. 3 along the line 3-3.

The internal member 15 is retracted into housing 25 with a lift motor 77 as seen in FIG. 6. The lift motor 77 is protected from contact by lift motor box 54. A power chord 35 supplies electrical power to the downdraft ventilator 1. A screw drive 76 is rotated by the lift motor 77 to retract the inner member 15 until the inner member contacts mechanical stop 18, which is the fully retracted position. When the internal member 15 is being extended, the lift motor 77 rotates the screw drive 76 until the internal member 15 contacts mechanical stop 16, which is the fully extended position. In an alternate embodiment shown in FIG. 5, spacers 17 prevent the cap 5 from resting flush against the trim panel 20. This prevents the cap 5 from pinching an object such as an operator's fingers between the cap 5 and the trim panel 20 when the internal member is in the fully retracted position.

FIG. 1B discloses the blower housing 55 attaching to the housing 25 by fastening the blower housing 55 to a mounting panel 30. FIG. 1C discloses the housing 45 fastened to the mounting panel 30 along a pair of mounting slots 56. The mounting slots 56 allow the housing 45 to be positionable along the length of the slots. Housing 45 includes an opening on the lower side for attachment of duct work to a remote fan and blower. The mobility of housing 45 allows it to clear any potential obstructions during installation. Looking now to FIG. 1B, the blower housing 55 is secured over hole 11 as seen in FIG. 1A. The blower housing may also rotate about its central axis along rotation arrow 80, as seen in FIG. 8, allowing the exhaust duct 40 versatility in location when it is attached to exhaust plumbing to vent the collected fumes to a remote location.

Figure 2:
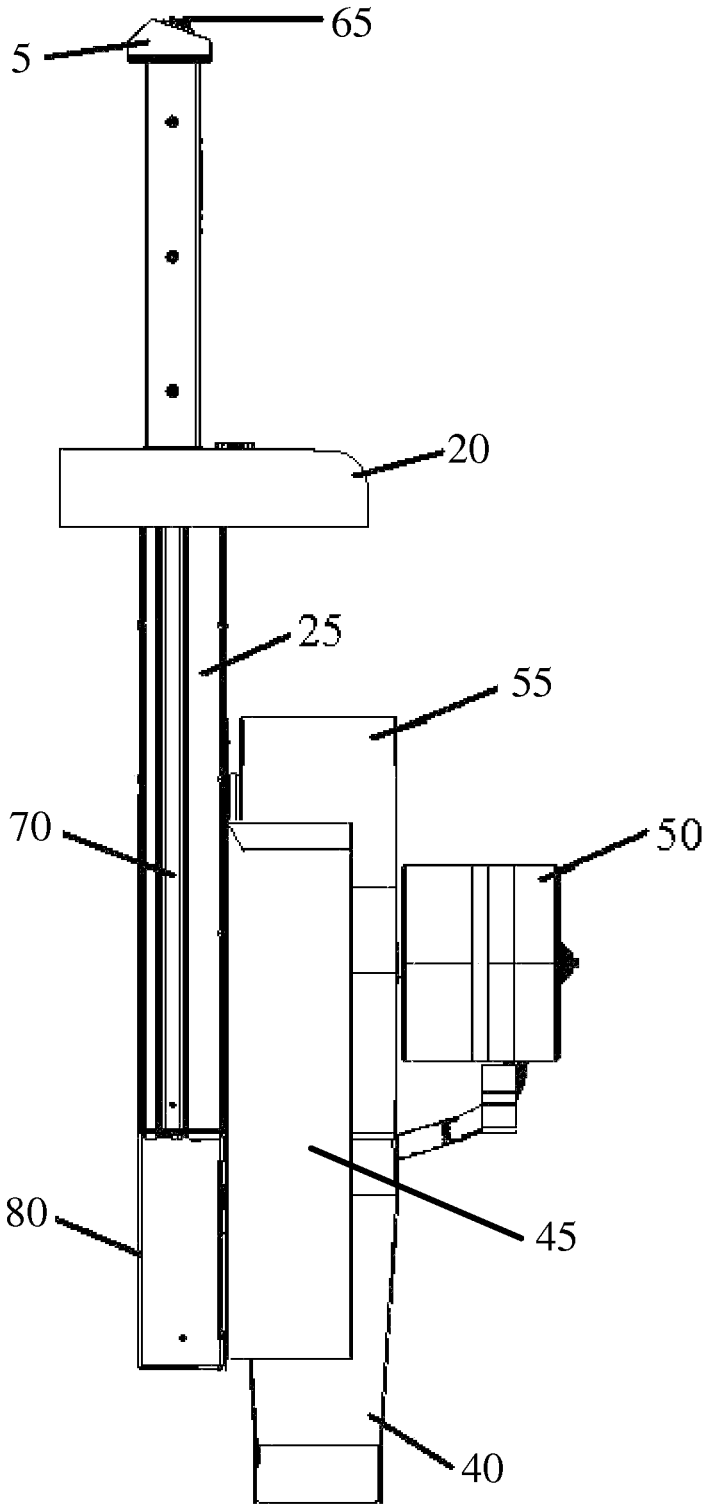
FIG. 2 illustrates a right side view of an alternate embodiment of the telescoping downdraft ventilator.
Figure 3:
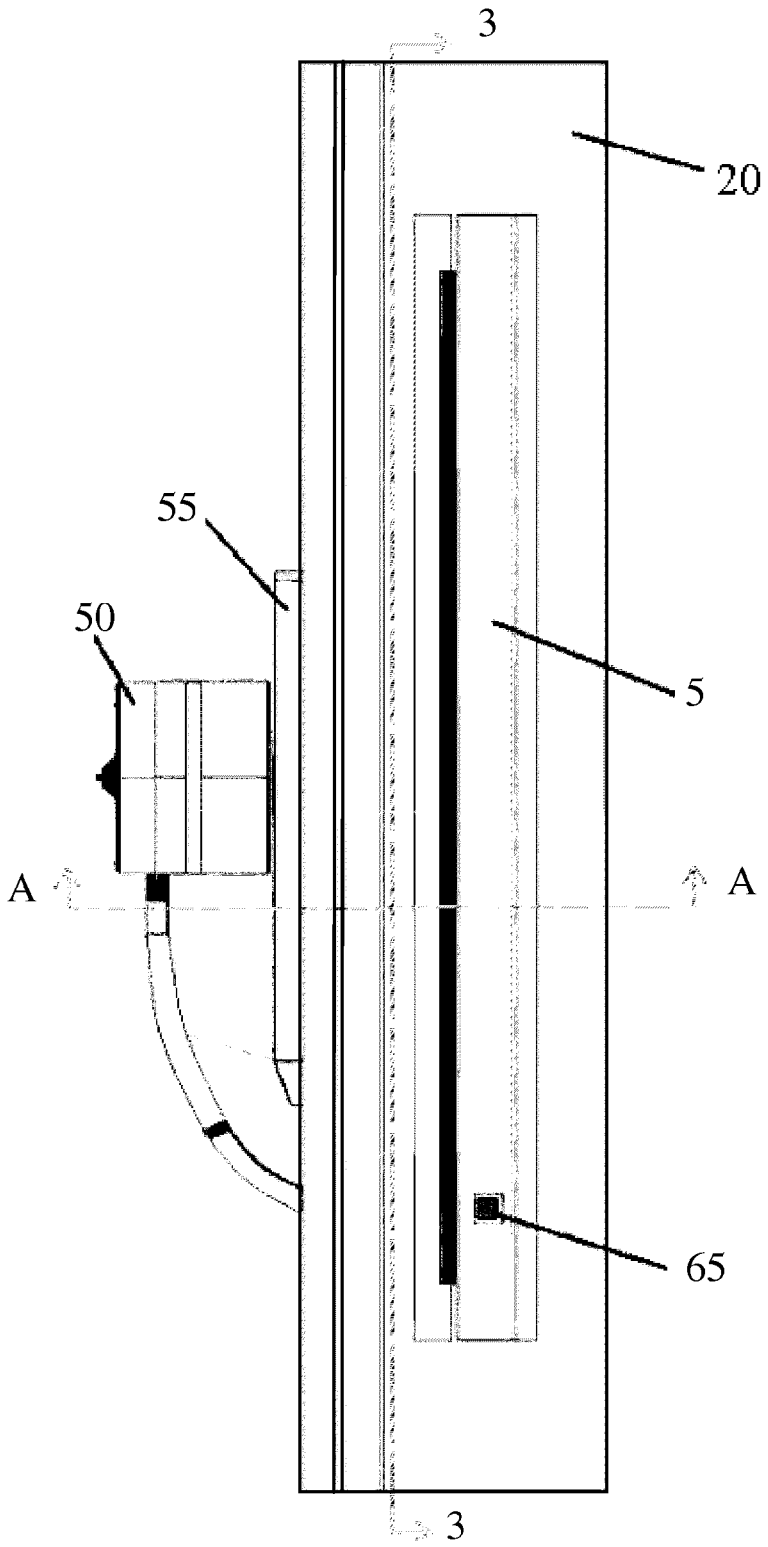
FIG. 3 illustrates a top view of the telescoping downdraft ventilator.
Figure 4:
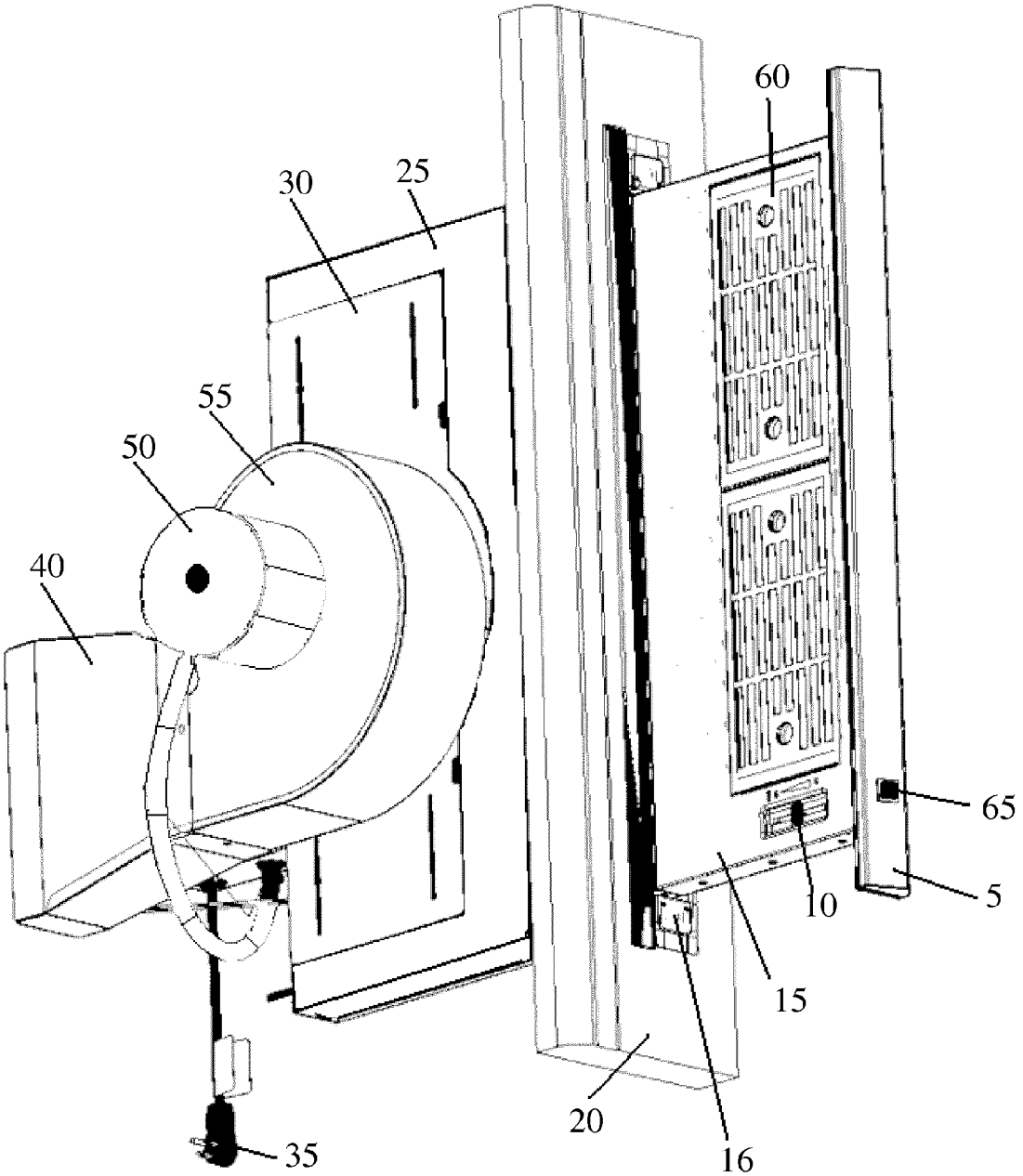
FIG. 4 illustrates an isometric view of the telescoping downdraft ventilator.

Looking to FIG. 2, an alternate embodiment of the telescoping downdraft is shown. Blower housing 55 is joined with housing 45. This embodiment allows the blower housing 55 to be mounted on mounting slots 56, allowing the fan 57, fan motor 50, and blower housing 55 to be movable along the mounting slots 56.

FIG. 5 illustrates the rear side of the downdraft ventilator 1. A hole cutout panel 28 seals a hole cutout 29 in the rear of the housing 25. The front side hole cutout 11, as seen in FIG. 1A, and the rear side hole cutout 29 allow the fan housing 55 of FIG. 1B and the housing 45 of FIG. 1C to be mounted on the front side or rear side of the downdraft ventilator. The hole cutout panel 28 may be swapped with cover plate 30 allowing the fan housing 55 and housing 45 to be mounted to either one of the front or rear sides of the downdraft ventilator 1.

Figure 7:
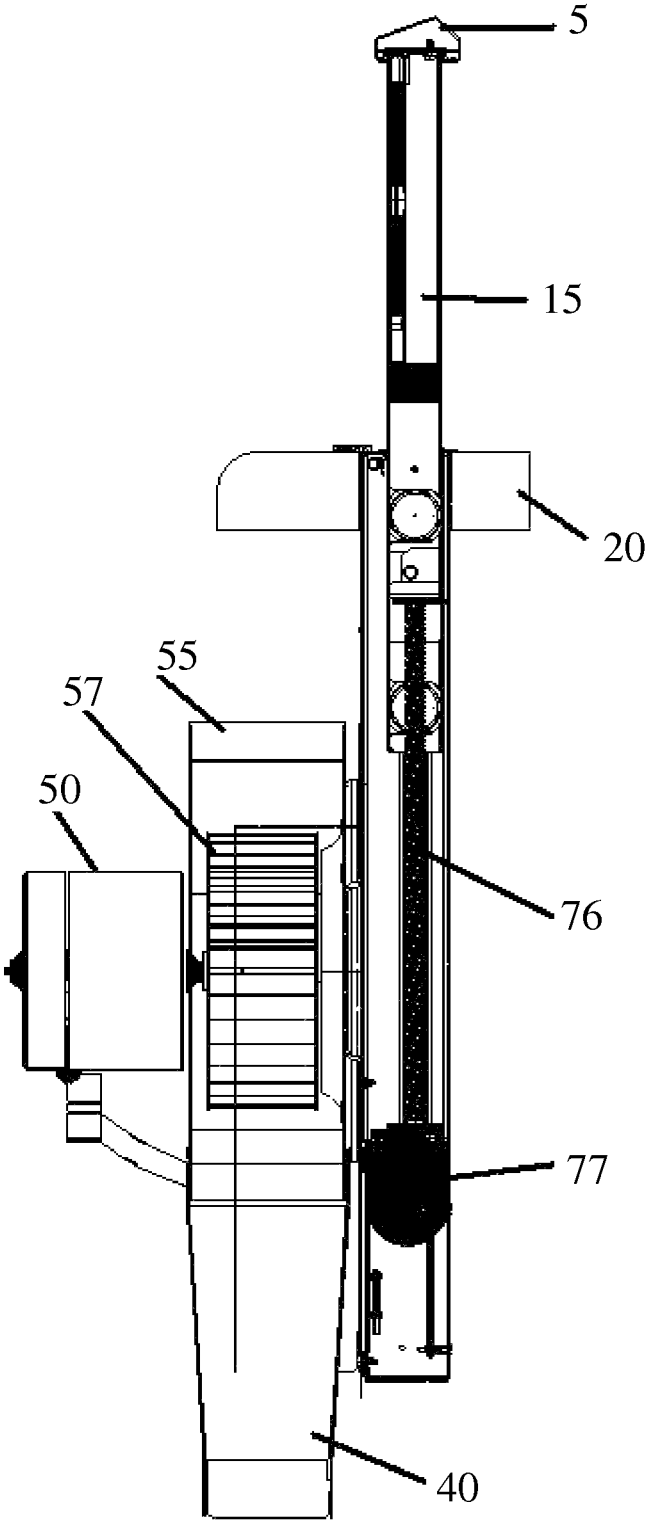
FIG. 7 illustrates a cross-sectional view of the downdraft ventilator of FIG. 3 along the line A-A.

Switching now to FIG. 7, a section view along 2-2 shows the internals of the fan housing 55. The fan 57 is spun by the fan motor 50 which draws air through the vent 60, down the internal member 15, down the housing 25, through the fan housing 55, and out of the exhaust vent 40. Lift motor 77 extends and retracts the internal member 15 into and out of the housing 25. In the fully retracted position, the bottom portion of cap 5 rests on the top portion of trim panel 20, allowing the cap 5 to protrude from the top surface of trim panel 20. An alternate embodiment may include spacers 17 to prevent the cap 5 from resting flush against the trim panel in the fully retracted position in order to minimize pinching of an obstruction such as a user's fingers. In the preferred embodiment, spacers 17 are not included and the cap is constructed out of a single piece. A flange is formed on the underside of the cap 5 allowing the underside of the edges of cap 5 to bend at a 90 degree angle in order to increase the surface area of the bottom portion of the cap 5. The increased surface area minimizes the force exerted by the cap 5 on an obstruction such as an operator's fingers. The cap 5 is also manufactured out of a single piece without any joining of separate pieces. This allows for lower manufacturing costs as welding, fasteners, bonding agents, and the like are all avoided.

Looking to FIG. 8, an alternate embodiment of the downdraft ventilator 1 is shown. The fan housing 55 may be rotated about its central axis. Rotation 80 of the fan housing 55 is accomplished by allowing the fan housing 55 to slidingly engage a mounting panel 45 until the fan housing 55 is at a preferred position. The fan housing may then be fastened to the mounting panel with fasteners.

Figure 9:
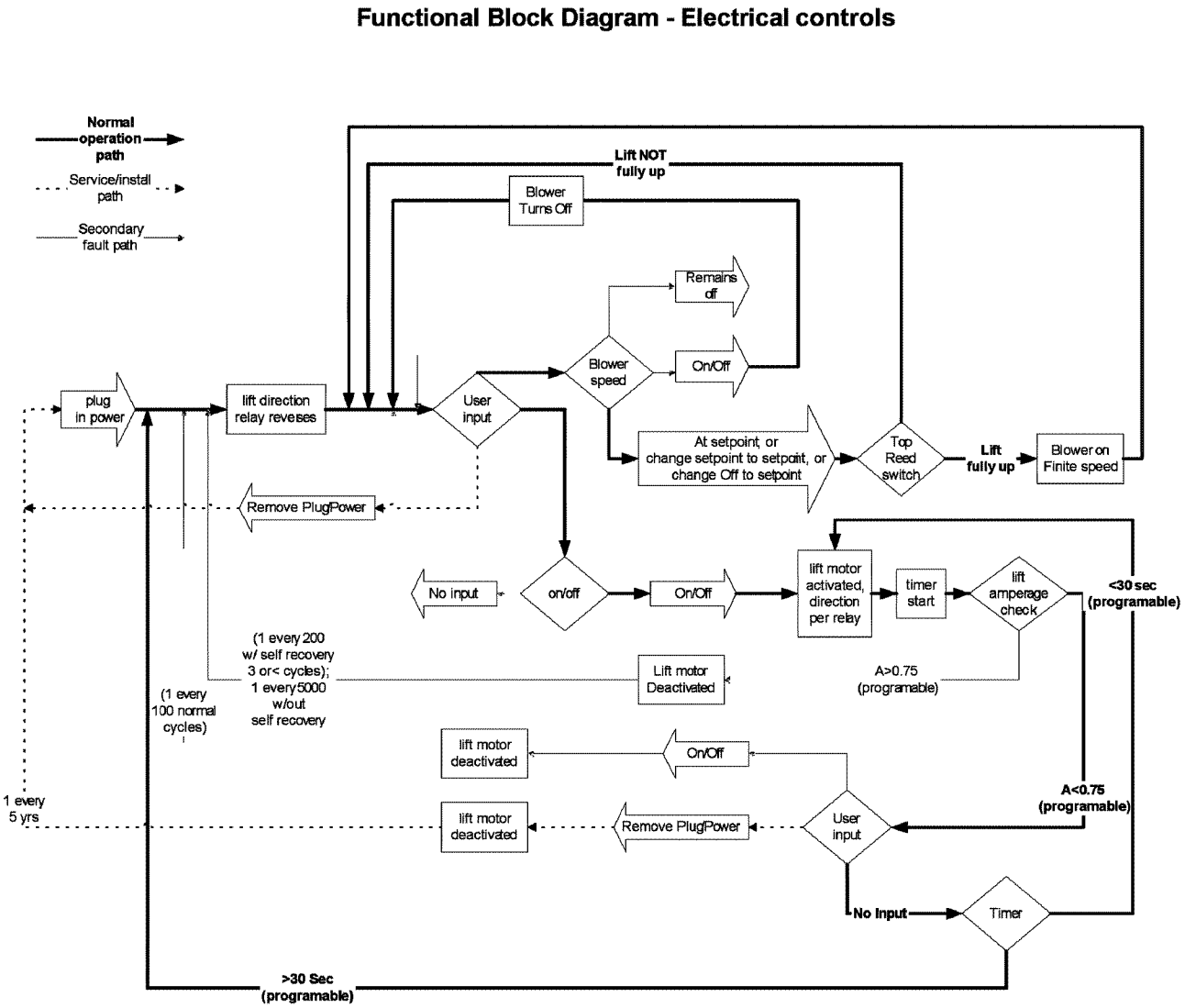
FIG. 9 illustrates a the electrical control block diagram of the preferred embodiment.

Now turning to FIG. 9, a function block diagram illustrates the electrical controls of a preferred embodiment of the fan motor 50 and lift motor 77. The fan motor 50 is operated by a separate 120 V variable speed control. The variable speed control accepts up to five discrete contact switch inputs or in a preferred embodiment, a 10K potentiometer input such as a sliding switch 10. The lift motor 77 is driven off a fixed, isolated DC voltage, which is separate from the variable speed control. The screw drive 76 rotational direction is controlled by reversing polarity of the DC power supplied to the lift motor 77. The internal member has mechanical stops 16 at the fully extended position and a mechanical stop 18 at a fully retracted position, which are seen in FIG. 6. When the internal member 15 engages one of the mechanical stops 16 or 18, a latching directional relay will change the direction of the lift motor 77 after the up/down button 65 is pressed. Any obstruction causing the lift motor amperage to go over the maximum programmed amperage will stop the lift motor 77 automatically. The internal member's mechanical stops 16 at the fully extended and the mechanical stop 18 at the fully retracted positions will also cause an over-current condition on the lift motor 77 when the internal member 15 contacts the respective mechanical stop and the lift motor 77 will stop the internal member 15 from movement automatically. In all events, pressing the on/off button 65 will reverse the travel direction of the inner member 15. In the event the internal member 15 contacts an obstruction such as a user's finger while the lift motor 77 is extending or retracting the internal member 15, the user must press the on/off button 65 to reverse the internal member's travel direction and reset the lift motor 76. Once the obstruction is cleared, normal operation will resume. If not, the fault cycle will continue. The control system will not differentiate between an obstruction and contact of the mechanical stops 16, 18 at the fully extended and fully retracted positions, respectively. When the inner member 15 reaches the fully extended position, a reed switch activates the fan motor 50 automatically at a preselected speed.

Figure 10:
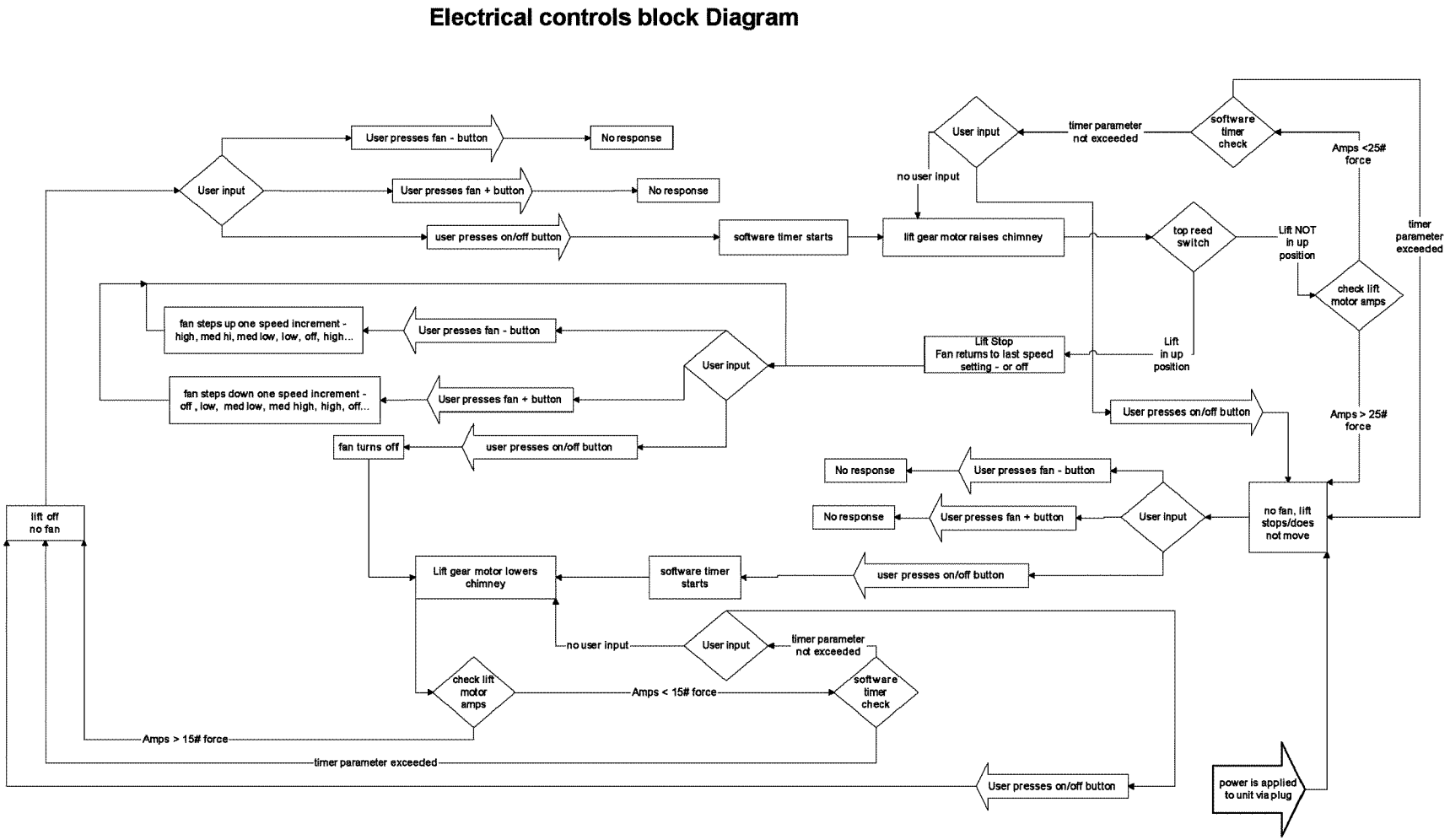
FIG. 10 illustrates the electrical control block diagram of an alternate embodiment.

Referring now to FIG. 10, the block diagram illustrates a flow chart detailing the function of the telescoping downdraft according to an alternate embodiment. The downdraft ventilator controls include a feature that senses an obstruction when the internal member 15 is interrupted during retraction or extension with a user's hands or another object. An obstruction when the internal member 15 is being extended will generally stop the lift motor 77 and prevent the fan motor 50 operation. The user must press the on/off button 65 to reverse the lift motor 77 and reset the unit. If the obstruction is cleared, normal operation will resume. If not, it will continue the fault cycle. Upon retracting the inner member 15 to the fully retracted position, the unit will not differentiate between an obstruction and the fully retracted position. The internal member 15 could potentially be retracted to an intermediate position in-between the fully extended and fully retracted positions. The telescoping downdraft ventilator 1 would also function as usual when this happens. Upon extending the inner member 15, the unit will differentiate between an obstruction and the fully extended position. Upon an obstruction stop, the user must press the on/off button 65 to reverse the lift motor 77 to retract the internal member 15 to the fully retracted position. If the obstruction is cleared, normal operation will resume with the on/off button 65 operation. If not, the same fault cycle will continue.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

We claim:

1. A downdraft ventilator comprising:

an internal member including a top side and a bottom side;

a housing for surrounding the internal member with a top portion and a bottom portion, the housing including a front panel, a rear panel, first and second end panels, and wherein the front panel and the rear panel each have a cutout;

a cover plate attachable to one of the front panel and the rear panel;

the cover plate sealing the cut-out on at least one of the front panel or rear panel when attached to the respective panel;

a duct formed from the housing and the internal member, the duct having an intake opening;

an actuator operatively connected to the internal member to telescopingly move the internal member parallel to the housing;

a button above the top side of the internal member allowing an operator to select an internal member position anywhere between a fully extended position and a fully retracted position; and a fan housing mountable over the cutout on one of the front panel and the rear panel opposite of the cover plate;

a mounting panel disposed between the fan housing and the one of the front panel and the rear panel and coupled to the one of the front panel and the rear panel;

wherein the mounting panel comprises a plurality of mounting slots; and wherein the fan housing is slidably positioned along a length of the mounting slots.

2. A downdraft ventilator according to claim 1, wherein the fan housing includes one of:

A) a fan in the fan housing fluidly connected to the housing and internal member, a fan motor connected to the fan, and an exhaust duct mounted to the fan housing; or B) an exhaust duct connected to the fan housing with a remotely located fan and a remotely located fan motor.

3. A downdraft ventilator according to claim 1, further comprising an exhaust duct connected to the fan housing wherein the fan housing and the exhaust duct are rotatable about a center axis, the center axis oriented perpendicular to the housing.

4. A downdraft ventilator according to claim 1, further comprising an electronic control system configured to:

1) control the actuator and the fan;

2) operate with a user interface;

3) utilize a DC power source; and 4) vary the current supplied to a fan motor for controlling a fan speed.

5. A downdraft ventilator according to claim 2, wherein the fan includes a speed that is infinitely adjustable between an off position and a maximum speed.

6. A downdraft ventilator according to claim 5, further comprising a sliding switch integrated with the internal member to adjust the fan speed between the off position and the maximum speed.

7. A downdraft ventilator according to claim 1, further comprising:

a cap mounted to the top side of the internal member, the cap having a convex cross section;

at least one spacer on a bottom portion of the cap;

a single piece of trim surrounding the internal member; and wherein the at least one spacer rests against the trim when the internal member is in the fully retracted position.

8. A downdraft ventilator according to claim 1, further wherein the actuator is configured to be operatively connected to the internal member to telescopingly move the internal member and is configured to move the internal member parallel to the housing anywhere between a first position and a second position.

9. A downdraft ventilator according to claim 8, wherein the internal member is configured to remain indefinitely at an infinite number of heights between the first position and the second position.

10. A downdraft ventilator according to claim 9, wherein the internal member is fully retracted within the housing at the first position; and the internal member is fully extended beyond the housing at the second position.

11. A downdraft ventilator according to claim 1, further wherein the actuator is a screw drive that allows the internal member to be adjusted to an infinite number of heights between a first position and a second position.

12. A downdraft ventilator according to claim 2, wherein the fan is a centrifugal blower.

13. A downdraft ventilator comprising:

a housing having a top end, a bottom end, a front side having a first cutout, and a back side having a second cutout;

an internal member sized to fit within the housing, the internal member having an intake opening;

a duct formed by combining the housing and the internal member;

a fan assembly rotatably mounted to the housing and over one of the first cutout and the second cutout about a central axis to allow a fan outlet to be positionable in a selected direction;

a fan intake positioned outside the housing and in fluid communication with the intake opening;

a cover plate mounted over the other of the first cutout and the second cutout;

a mounting panel coupled to the housing and disposed between the housing and the fan assembly;

wherein the mounting panel comprises a plurality of mounting slots;

wherein the fan housing is slidably positioned along a length of the mounting slots; and wherein the internal member is telescoping with respect to the housing so as to allow for a portion of the fan intake opening to extend beyond the top end of the housing.

14. A downdraft ventilator according to claim 13, further comprising:

a sliding selector switch on the internal member allowing selection of a fan speed;

a trim of one piece construction surrounding the internal member; and the trim having a top side and an underside wherein the underside is in contact with the internal member forming a surface area.

15. The downdraft ventilator according to claim 14 further including a cap mounted to the top side of the internal member, the cap having a convex cross section; and at least one spacer on a bottom portion of the cap;

wherein the at least one spacer rests against the trim when the internal member is in the fully retracted position.

16. A downdraft ventilator comprising:

a housing including a front side hole cutout and a rear side hole cutout;

an internal member having an upper end with an intake opening and sized to fit within the housing that is slidable within the housing to allow for a portion of the intake opening to extend beyond an upper end of the housing;

a duct formed from the housing and the internal member;

a fan housing including a fan;

an actuator operatively connected to the internal member and the housing, the actuator being configured to move the internal member to a desired position with respect to the housing;

an electronic control system having a user interface that controls the actuator and the fan;

a cover plate coupled to the housing over one of the front side hole cutout and the rear side hole cutout, wherein the cover plate seals the one of the front side hole cutout and the rear side hole cutout;

a fan housing coupled the housing over one of the front side hole cutout and the rear side hole cutout opposite of the cover plate; and a mounting panel coupled to the housing and disposed between the fan housing and one of the front side hole cutout and the rear side hold cutout;

wherein the mounting panel comprises a plurality of mounting slots; and wherein the fan housing is slidably positioned along a length of the mounting slots.

17. A downdraft ventilator according to claim 16, further comprising:

a sliding selector switch on the internal member allowing selection of a fan speed; and a trim of one piece construction surrounding the internal member.

18. A downdraft ventilator according to claim 16, further wherein the actuator is configured to be operatively connected to the internal member to telescopingly move the internal member and is configured to move the internal member parallel to the housing anywhere between a first position and a second position.

* * * * *